US006167112A

United States Patent [19]

Schneider

[11] Patent Number: 6,167,112

[45] **Date of Patent: *Dec. 26, 2000**

[54] X-RAY MICROSCOPE WITH ZONE PLATES

[75] Inventor: Gerd Schneider, Eichendorffweg 1, Bockenem, Germany, D-31167

[73] Assignees: Bastian Nieman, Goettingen; Gerd Schneider, Bockenem, both of Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/101,552

[22] PCT Filed: Jan. 13, 1997

[86] PCT No.: PCT/DE97/00045

§ 371 Date: Jul. 13, 1998

§ 102(e) Date: Jul. 13, 1998

[87] PCT Pub. No.: WO97/25723

PCT Pub. Date: Jul. 17, 1997

[30] Foreign Application Priority Data

Jan. 12, 1996 [DE] Germany ..... 196 00 895

[51] Int. Cl.[7] ..... G21K 7/00

[52] U.S. Cl. ..... 378/43; 378/145

[58] Field of Search ..... 378/43, 145

*Primary Examiner*—Craig E. Church

*Attorney, Agent, or Firm*—Foley & Lardner

[57] ABSTRACT

Light-intensive zone plates (4) are disclosed which are useful as condensers and X-ray objectives for high resolution X-ray microscopes. They have high refraction effectiveness in a high refraction order thanks to a high aspect ratio (H/P) and a suitably adjusted line-slot ratio ($P_1/P_2$) lower than 1. Additional improvements may be obtained by zones (6, 7) inclined relative to the optical axis (3). The zone plates (4) may also be operated in Bragg reflection. They thus provide efficient optics with a high numeric aperture and make X-ray microscopes with 10 nm resolution possible. The zone plates (4) may have a relatively coarse structure, and thus they are easy to produce in a relatively short time. The zone plates (4) with high numerical aperture may be used in a particularly advantageous manner as small condensers in laboratory X-ray microscopes, as they can capture light from a microplasma X-ray radiation source in a particularly wide solid angle and focus it on an object.

21 Claims, 2 Drawing Sheets

X-RAY MICROSCOPE WITH ZONE PLATES

Figure 1:
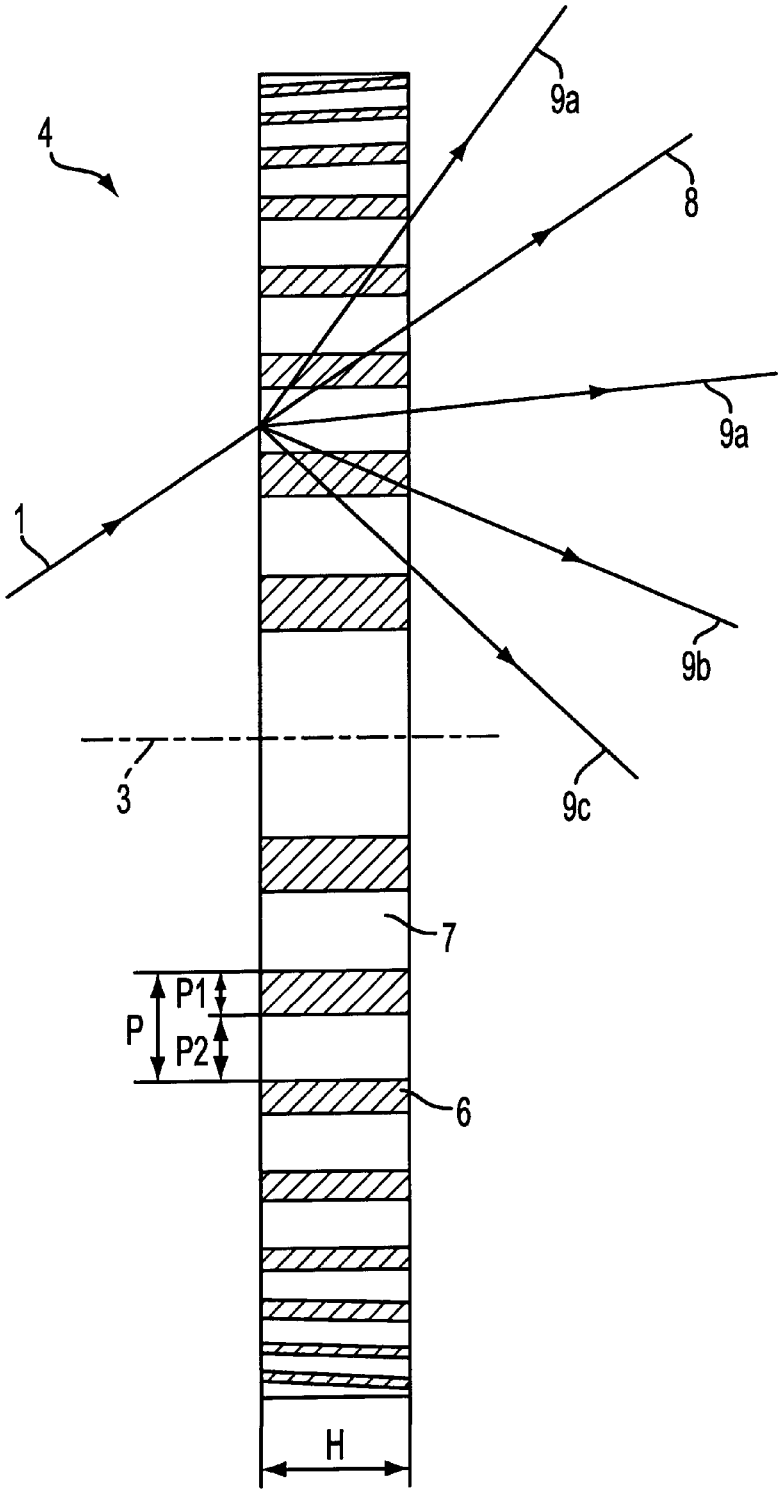

Th e invention relates to an X-ray microscope with zone plates for a condenser-monochromator and for a microscope objective.

In X-ray microscopy, substantial progress has been made over recent years in the wavelength region of approximately 0.2–5 nm. X-ray microscopes have been developed which are being operated on brilliant X-ray sources. Electron storage rings emit strongly focused X-ray radiation. Also included in the development are compact X-ray sources which are intended for the use of X-ray microscopes in the laboratory. Such X-ray sources can consist of hot micro-plasmas (typical diameter of the radiating region: 10–50 $\mu$m) which are generated with the aid of pulsed laser beams. They radiate their X-ray light in all spatial directions.

At present, only microscope zone plates are used as highly resolving objectives in X-ray microscopes. Microscope zone plates are rotational symmetrical circular transmission gratings with grating constants which decrease outward, and typically have diameters of up to 0. 1 mm and a few hundred zones. The numerical aperture of a zone plate is determined very generally by the diffraction angle at which the outer, and thus finest zones diffract vertically incident X-ray beams. The achievable spatial resolution of a zone plate is determined by its numerical aperture. Over recent years, it has been possible for the numerical aperture of the X-ray objectives used to be substantially increased, with the result that their resolution has improved. This trend to higher resolution will continue.

It is known from the theory of microscopy that the numerical aperture of the illuminating condenser of a transmitted-light microscope should always be approximately matched to the numerical aperture of the microscope objective, in order also to obtain an incoherent object illumination from incoherently radiating light sources, and thus to obtain a virtually linear relationship between object intensity and image intensity. If the aperture of the condenser, by contrast, is less than that of the microscope objective, a partially coherent image is present, and the linear transformation between object intensity and image intensity is lost for the important high spatial frequencies, which determine the resolution of the microscope.

A condenser of high light-gathering power must be used for it to be possible to use the X-ray sources in a simple and matched [sic] way for bright-field microscopy, phase contrast microscopy and, in particular, dark-field microscopy. Normally, use is also made as condensers of diffracting optical systems, for example zone plates, since these may be used to render the X-ray radiation monochromatic at the same time. Such zone plates are to have a diffraction efficiency that is as high as possible, in order to focus as much of the captured radiation as possible onto the object.

Such "condenser zone plates" are normally used at the first diffraction order, at which all condenser zone plates implemented to date have their highest diffraction efficiency. It is difficult in this case to achieve the previously required matching of the numerical aperture of the condenser zone plates to that of the microscope zone plate (X-ray objective). In order to realize the matching, the condenser zone plate must have the same fine zones on the outside as does the microscope zone plate itself. The microscope zone plates built with the highest light-gathering power meanwhile have zone widths of only 19 nm (corresponding to a 38 nm period of the zone structures). Zone plates with such fine zone structures can so far be produced only using methods of electron beam lithography, in which the zones are produced successively. Holographic methods, which produce the pattern of a zone plate in one step in a "parallel" fashion and thus in a short time are ruled out, since a suitably shortwave UV holography does not exist. Consequently, it would also be possible to produce condenser zone plates with matched numerical apertures only using methods of electron beam lithography, and this must be described as a serial, and thus slow method. However, such condenser zone plates have not yet been produced to date.

Condenser-monochromator arrangements of even higher light-gathering power and having an annular hollow conical aperture are required for dark-field X-ray microscopy, if an absorbing ring, which is to be adjusted very precisely, is not placed in the rear focal plane of the microscope objective. The periods of the zone structures of suitable condenser zone plates would, in turn, need to be less than 38 nm.

A condenser-monochromator arrangement which as far as possible delivers all the X-ray light made available by the beam tube into an annular hollow conical aperture of large aperture angle relative to the object is advantageous for phase-contrast X-ray microscopy.

Object illumination of hollow conical shape is generally required for X-ray microscopes which use zone plates as X-ray objectives. Otherwise, the radiation from the zero and the first diffraction orders of the condenser zone plate would also overlap the image at its center. The reason for this is that the overwhelming proportion of the radiation which falls onto the object in a fashion parallel or virtually parallel to the optical axis penetrates said object and the following microscope zone plate (the X-ray objective) without being diffracted and is seen as a general diffuse background in the direction straight ahead, that is to say in the center of the image field. For this reason, all transmitting X-ray microscopes use annular condensers, and the useful region, not diffusely overexposed region, of the image field becomes larger the larger the inner, radiation-free solid angle region of the condenser.

In order to improve the resolution of the X-ray microscopes to 10 nm, work is presently being carried out on developing microscope zone plates which have a minimum zone width of only approximately 10 nm. This increases the apertures of the microscope zone plates and, consequently, the required numerical apertures of the condensers, in order to ensure an incoherent object illumination. The already mentioned difficulties are thereby compounded further.

Such highly resolving microscope zone plates would need to have zones with a structural width of approximately 10 nm. However, so far no success has been achieved nor explanation given as to whether such exposed zone structures carried by a backing foil, which generally consists of a metal such as germanium or nickel, can still be produced with the aid of electron beam lithography and transmitted into metal. It has also not been shown for sputtered-sliced zone plates that it is possible to use the sputter method for such small structural widths to produce sufficiently stable zone rings which are not disturbed by material diffusion and can finally be further processed into a zone plate by means of thinning methods, it being the case in particular, that the zones should preferably be capable of being etched out of material of low scattering power, thus producing the profile of a laminar structure.

It is generally known from diffraction theory in optics that, with higher diffraction orders, it is possible in principle to achieve higher apertures, and thus a spatial resolution which is higher by the factor of the diffraction order m. If the finest structural width is 30 nm, for example, something which is simple to produce, a resolution of 10 nm would theoretically be possible in the third diffraction order. However, in this case it would also be necessary to reach a diffraction efficiency which far exceeds that of the other diffraction orders.

The diffraction efficiency of zone plates as X-ray optical systems has so far been calculated within the framework of an approximation in geometrical optics. In this case, it has been assumed that the aspect ratio of the zone structures, that is to say the ratio of the zone height to the length of the zone period is distinctly smaller than 10:1. According to this approach, it is impossible in principle to expect a high diffraction efficiency at high diffraction orders. On the contrary, the maximum possible diffraction efficiency scale with $1/m^2$ for the diffraction orders m=1,3,5 . . . , with the result that only a few percent is possible according to this model. The diffraction efficiency is correspondingly lowered for the third diffraction order by the factor $\sim 1/m^2=(1/3)^2=1/9$, at least, with the result that light is scarcely available any more at the higher diffraction order. The contrast of an image is therefore strongly attenuated by the radiation of the remaining, much more efficient diffraction orders. In practice, it has therefore not been possible so far to use zone plates at higher diffraction orders.

Again, it is known from the theory of coupled waves, applied to zone plates, that when they have an aspect ratio >1 zone structures can assume a particularly high diffraction efficiency only at their first order (up to approximately 50% for materials which are suitable for X-ray optics and realistic, that is to say can be technically processed). The precondition for this is that zone structures extend along the surfaces of constant phase, which can be constructed for an object point on the optical axis and for the associated image point. If said surfaces extend parallel to and concentrically with the optical axis, the zone structures act like the lattice planes of a crystal which is used with Bragg reflection and which therefore fulfills the Bragg condition. In very general terms, Bragg reflection occurs when the zone structures are inclined such that they extend parallel to the angle bisector ("Bragg angle") of the incident and diffracted beam directions. The talk will therefore be of "zone plates with Bragg reflection" for such a case in what follows.

Furthermore, a theoretical description based on the wave equation (theory of coupled wave) has been used to calculate the diffraction efficiency, in order to obtain more accurate data for the efficiencies of first order or higher aspect ratios, as well. A Fourier representation with a line/slot ratio of 1:1 has been used in the wave equation to describe the grating structures of the zone plate. The line/slot ratio specifies the ratio of the structural widths of the zone material which strongly scatters the X-ray radiation, and that which weakly scatters it. The system of differential equations resulting therefrom has been numerically integrated, something which required many hours for one calculation even on a high-speed computer (for example IBM RS-6000), even in the case of layer thicknesses of less than 1 $\mu$m. However, in this connection it is only the first order which has been considered as imaging order. The theoretical results for the diffraction efficiencies agreed to a very good approximation with the approach of geometrical optics in the case of aspect ratios up to a maximum of approximately 5:1. Only at higher aspect ratios and with inclination of the zone structures was it possible for higher efficiencies to be calculated in accordance with the model in geometrical optics. It has so far seemed to be impossible, both in accordance with the model in geometrical optics and from the theory of coupled waves, to obtain high diffraction efficiencies for higher diffraction orders (m=2,3, . . . ) as well. Experimental results have also not indicated this in any way.

It is the object of the invention to represent an X-ray microscope with a resolution of at least 10 nm, and to specify for this zone plates which can be operated at higher diffraction orders, the aim being to achieve at the higher diffraction orders diffraction efficiencies at least at a level such as is exhibited by the known zone plates operated at the first diffraction order, and whose zone structures can be distinctly coarser than 10 nm, and which are suitable for use in condenser-monochromator arrangements and as microscope objective.

This object is achieved according to the invention by means of the features specified in the characterizing part of claim 1. Advantageous embodiments and developments of the invention follow from the subclaims.

A resolution of 10 nm can be achieved if the specified zone plates are used in an X-ray microscope as a condenser-monochromator and as a microscope objective. The diffraction efficiency of said zone plates reaches its maximum at a higher diffraction order by means of a suitably set line/slot ratio of less than 1:1 and a high aspect ratio. Efficient X-ray optical systems with the necessary high numerical aperture are thereby available. In addition, they render X-ray microscopes with a 10 nm resolution possible, without the need to use the extremely small zone structures, technically exceptionally difficult to produce, which would be necessary for zone plates of the same resolution in the case of the use of the first diffraction order. At the same time, a diffraction efficiency which it has so far been possible to achieve only at the first diffraction order is achieved at this higher diffraction order. Such zone plates with a high diffraction efficiency and a high numerical aperture can be used in laboratory X-ray microscopes with particular advantage as small condensers which capture light from a microplasma X-ray radiation source from a particularly high solid angle, and focus it on the object.

The way of achieving the object set could only be via a comprehensive analytical description of the diffraction behavior of zone plates which provides an overview of all diffraction orders, different line/slot ratios and much larger zone heights. Because of the enormous rise in computation time required, this object was ruled out with the numerical iterative methods of calculation to date.

There were two problems to overcome in this case. Firstly, it was necessary to find another mathematical method for distinctly shortening the computation time, in order to be able to calculate even large aspect ratios sufficiently quickly. On the other hand, it was necessary for the line/slot ratio to be incorporated into the wave equation as a further parameter, and said ratio distinctly complicates the Fourier representation of the grating, and thus the wave equation. The result was a system of differential equations which was solved as a complex-value eigenvalue problem, complex-value matrices occurring up to a dimension of 100×100 elements. This method of solution reduced the computation times by a factor of approximately 1000. The efficiency of any diffraction order can be represented as a function of the zone height. It has been shown that the diffraction efficiency at high orders (for example m=6) can be drastically raised if the line/slot ratio is selected to be smaller than 1:1, the zones have a high aspect ratio and, in addition, the zone structures are arranged in a fashion similar to small mirrors with Bragg reflection.

This had not been known to date, and is to be understood only by means of a comparison, not drawn until now, relating to the mode of operation of multilayers. In practice, this effect can be utilized for the purpose of realizing high diffraction efficiencies and high apertures in X-ray optical systems, without at the same time being dependent on the production of extremely narrow zone structures, as would be necessary for operation at the first diffraction order.

It has emerged that a zone plate with a high aspect ratio (typical value: greater than 10) has a comparatively high diffraction efficiency at one of its high diffraction orders, like a zone plate with a high aspect ratio used at the first diffraction order, if said line/slot ratio is distinctly smaller than one. Since such a zone plate is used at a high diffraction order, it has a greatly increased aperture—compared with applications at the first diffraction order. For example, a zone plate with a high aspect ratio (approximately 20) and a low line/slot ratio (approximately 0.25) can have a diffraction efficiency of up to 45% if it is used at the sixth diffraction order and with Bragg reflection at a wavelength of 2.4 nm. Materials suitable for X-ray optics and capable of being processed technically are used for this purpose. It holds in very general terms that the parameters of the zone plate such as, for example, materials, aspect ratio and line/slot ratio can be optimized for the higher diffraction order respectively desired.

Given the use of a higher diffraction order and Bragg reflection—it is an advantage of zone plates with a large aspect ratio and small line/slot ratio that in the case of the same numerical aperture a zone plate used at a high diffraction order requires only relatively coarse zone structures by comparison with a zone plate of the same numerical aperture used at the first diffraction order. For the above example of an X-ray microscope with a resolution of 10 nm, the result for the finest zone structure to be produced is a width of approximately 30 nm with a period of 120 nm, if the zone plate is to be operated at the sixth diffraction order. Such structural widths can be effectively produced at the present time using means of electron beam lithography. In addition, zones 6 times smaller are to be written, and this proceeds substantially more quickly. For a zone plate condenser written by electron beam, this means that the write times are drastically reduced.

A zone plate for Bragg reflection can be reduced using known vapor deposition techniques, for example according to the known method for producing so-called sputtered-sliced zone plates by sputter coating of a polished wire rotating in a vacuum, the materials suitable for X-ray optics being applied alternately. The wire with the materials applied is subsequently embedded in a substrate and cut into disks at right-angles to its axis. This produces zone plates whose inner region is absorbing, that is to say inactive in terms of X-ray optics, and this is desired for the condenser on the grounds set forth in the introduction.

Instead of a wire, it is possible to use an optically polished metal or glass ball as an alternative method for producing a zone plate. The ball—which is rotating—is coated in a vacuum with a multilayer system and subsequently thinned on its circumference down to a ball zone with a width of a few $\mu$m near its equator. If the thinned ball zone is not situated exactly on the equator of the ball, the remaining layer sequence is inclined. If the inclination is half as large as the required beam deflection and corresponds to the above-named angle bisector, the layer sequence is at the Bragg angle. The layer sequence acts like a multiple mirror, with the result that a maximum is achieved in the diffraction efficiency.

Figure 2:
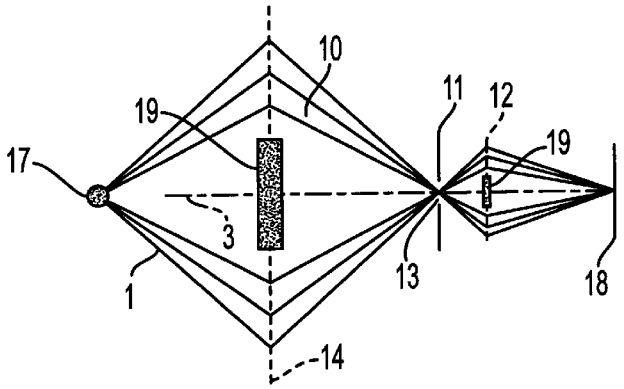
Figure 3:
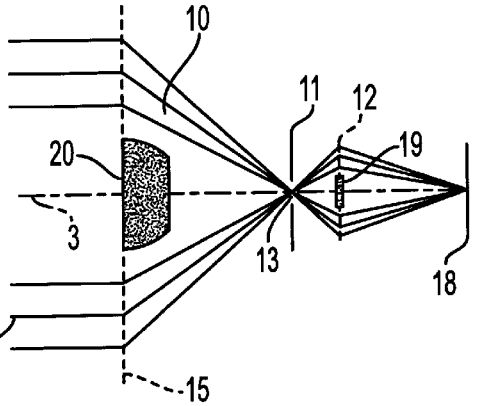
Figure 4:
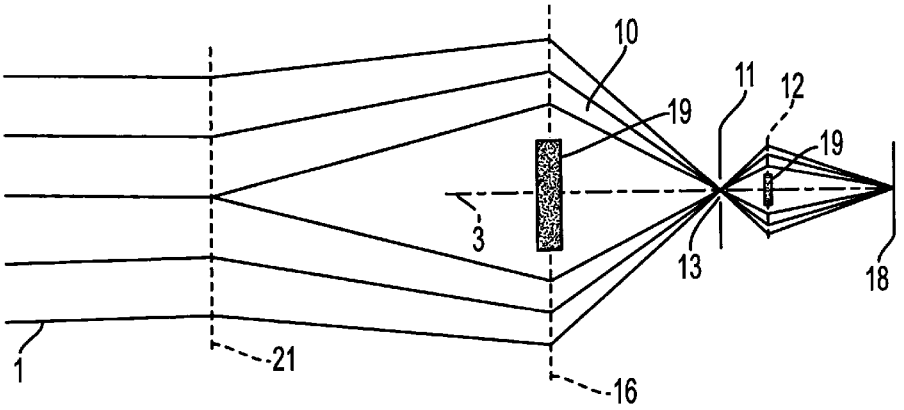

Diagrammatically represented exemplary embodiments of the invention are explained below in more detail with the aid of the drawing, in which:

FIG. 1 shows a zone plate according to the invention,

FIG. 2 shows an X-ray microscope with condenser and microscope zone plate s, both of which are operated with Bragg reflection, FIG. 3 shows an X-ray microscope with condenser and microscope zone plates, both of which have inclined zones and are operated with Bragg reflection, and FIG. 4 shows an X-ray microscope having a focussing device with focussing ring and a downstream annular zone plate and a microscope zone plate.

An exemplary embodiment of a zone plate 4 according to the invention is represented diagrammatically in cross section in FIG. 1. The diffracting properties of the zone plate 4 are determined by the line/slot ratio $P_1/P_2$, the aspect ratio H/P and by the inclination of the zones 6,7 with respect to the optical axis 3. Of course, in this case the materials of the zones 6,7 which are active in terms of X-ray optics, also play a role. The line/slot ratio $P_1/P_2$ specifies the ratio of the structural width of the material of the zones 6, which strongly scatters the incident X-ray radiation 1, to the structural width of the material of the zones 7 which is weakly scattering. The line/slot ratio $P_1/P_2$ is constant over the entire zone plate 4. The aspect ratio specifies the ratio of the zone height H to the length P of the zone period, and increases in this exemplary embodiment, starting from the optical axis 3 toward the edge of the zone plate 4.

According to the invention, a high diffraction efficiency is achieved at a higher diffraction order when the line/slot ratio $P_1/P_2$ is smaller than 1, as is represented, for example, with 0.5 in a fashion true to scale in FIG. 1, and when a large aspect ratio such as, for example, greater than 10 is realized, which is not, however, represented true to scale in FIG. 1.

A further increase in the diffraction efficiency at a higher diffraction order can be achieved for specific applications with zones 6,7, which are inclined with respect to the optical axis 3. The exemplary embodiment in accordance with FIG. 1 shows zones 6,7 which extend near the optical axis 3 and parallel to said axis. With increasing spacing of the zones, 6,7 from the optical axis 3, there is also an increase in the inclination of zones 6,7 with respect to the optical axis 3. A further improvement can be achieved when the zone plate 4 with its zones 6,7 are used with Bragg reflection.

The X-ray radiation 1 incident on the zone plate 4 is diffracted with different intensities at different diffraction orders. FIG. 1 shows the propagation directions for the diffraction of zero order 8, first order 9*a*, second order 9*b* and third order 9*c*. The diffraction angle increases with the higher diffraction orders. It is therefore possible to achieve a high aperture, and thus a high resolving power of the X-ray microscope with a high diffraction order when the zone plate 4 is used as condenser and/or as objective in an X-ray microscope. In this case, coarse structures, which can advantageously be produced easily and in a relatively short time, suffice as zones 6,7 of the zone plate 4.

FIGS. 2–4 show diagrams of zone plates 4 in arrangements as condensers and microscope zone plates for X-ray microscopes with particularly high resolution, which are operated with various radiation sources.

FIG. 2 represents the optical system of an X-ray microscope in which an isotropically radiating microplasma X-ray source 17 serves as radiation source. A suitable condenser in this case is an annular zone plate 14 with non-inclined zones 6,7, which are advantageously operated with Bragg reflection. The zone plate 14 focuses the X-ray radiation 1 of the microplasma X-ray source 17 via a hollow cone of radiation 10 at the focus 13 on the optical axis 3. The object thereby illuminated is located there. Also arranged at said point is a monochromator pinhole diaphragm 11, which masks out the undesired diffraction orders and wavelengths of the X-ray light of a further beam path. The zone plate 14 thereby cooperates with the monochromator pinhole diaphragm 11 as a condenser-monochromator which is used generally for illuminating objects in X-ray microscopes.

A microscope zone plate 12 with incline d zones 6,7 and with Bragg reflection serves as X-ray objective. Said plate generates an image of the object in the image plane 18.

As already mentioned in the introduction, in order to eliminate the non-diffracted X-ray radiation as diffused background the zone plate 14 and the microscope zone plate 12 have a central zone plate region 19 which absorbs the X-ray radiation.

Represented in FIG. 3 is the optical system of an X-ray microscope which makes use as optical elements of a condenser zone plate 15 with Bragg reflection and inclined zones, and of a microscope zone plate 12 with Bragg reflection and inclined zones 6,7. The X-ray radiation 1, incident in a virtually parallel fashion, of an undulator or a deflecting magnet on an electron storage ring is focused at a high aperture angle and with high diffraction efficiency in an object in the plane of the monochromator pinhole diaphragm 11. In order to effect Bragg reflection in this application, the zones 6,7 of the condenser zone plate 15 must be inclined. The central zone plate region 20 absorbing the X-ray radiation comprises a spherical carrier.

Represented in FIG. 4 is an X-ray microscope having a focussing device 21 with focussing ring and an annular zone plate 16, downstream in the beam path, with Bragg reflection and inclined zones 6,7. Together with a monochromator pinhole diaphragm 11, the focussing device 21 and the zone plate 16 form a condenser-monochromator. The focussing device 21 with focussing ring focuses the incident X-ray radiation 1, focussed in parallel, of an undulator or a deflecting magnet of an electron storage ring in the form of a ring. The zone plate 16 is arranged near the focussing ring of the focussing device 21. The zones 6,7 of the zone plate 16 are modified such that they generate a punctiform focus 13 on the optical axis 3 by diffraction from the focussing ring of the focussing device 21. It is advantageous in this arrangement that the zone plate 16 does not need to have a large area, since it can be located near the focussing ring of the focussing device 21. Only a few structures therefore need to be produced on the zone plate 16. The light-collecting area is determined solely by the focussing device 21. It has only coarse zone structures, and can therefore be effectively produced using methods of electron beam lithography. This arrangement can be applied with particular advantage for well collimated X-ray radiation 1, for example from an undulator.

A microscope zone plate 12 with Bragg reflection and inclined zones 6,7 serves as X-ray objective in the case of this condenser-monochromator arrangement as well.

List of-Reference Symbols

1 Incident x-ray radiation
3 Optical axis
4 Zone plate
6 Zone with material of high scattering power
7 Zone with material of low scattering power
8 Beam of zero diffraction order
9*a* Beam of first diffraction order
9*b* Beam of second diffraction order
9*c* Beam of third diffraction order
10 Illuminating hollow cone of radiation
11 Monochromator pinhole diaphragm in the object plane
12 Microscope zone plate with high aspect ratio and inclined zones
13 Focus in the object plane
14 Annular zone plate with high aspect ratio and non-inclined zones
15 Annular zone plate with high aspect ratio and inclined zones
16 Annular zone plate with Bragg reflection with high aspect ratio and inclined zones
17 Microplasma x-ray source
18 Image plane
19 Central, absorbing zone plate region
20 Central, absorbing zone plate region composed of spherical carriers
21 Focussing device with focussing ring
H Zone height
P Period of the zones
$P_1/P_2$ line/slot ratio

I claim:

1. X-ray microscope with zone plates for a condenser-monochromator and for a microscope objective, characterized in that at least one zone plate is provided which is arranged on the optical axis of the X-ray microscope and has a high aspect ratio (H/P) and a line/slot ratio ($P_1/P_2$) smaller than 1.

2. X-ray microscope according to claim 1, characterized in that the aspect ratio (H/P) increases toward the edge of the zone plate.

3. X-ray microscope according to claim 1, characterized in that the central region of the zone plate is absorbent for X-ray radiation.

4. X-ray microscope according claim 1, characterized in that the zones of the zone plate are aligned parallel or inclined to the optical axis.

5. X-ray microscope according to claim 1, characterized in that in the region near the optical axis (3), the zones (6, 7) of the zone plate (4, 12, 14, 15, 16) are aligned parallel to said axis, and are increasingly inclined with respect to the optical axis (3) toward the edge of the zone plate (4, 12, 14, 15, 16).

6. X-ray microscope according to claim 1, characterized in that a zone plate operating with Bragg reflection is provided.

7. X-ray microscope according to claim 1, characterized in that the zone plate is annularly constructed for a condenser-monochromator, and a monochromator pinhole diaphragm is arranged at its focus.

8. X-ray microscope according to claim 1, characterized in that a focussing device with a focussing ring, and a zone plate of annular construction downstream in the beam path are provided for a condenser-monochromator, a monochromator pinhole diaphragm being arranged at the focus of the zone plate.

9. X-ray microscope according to claim 1, characterized in that the zone plate is used as a microscope objective.

10. X-ray microscope according to claim 1, characterized in that zone plates are provided whose zones are applied to a wire or a polished ball.

11. A zone plate with diffraction structure for X-ray radiation, the zone plate being characterized by a high aspect ratio (H/P) and a line/slot ratio ($P_1/P_2$) smaller than 1.

12. A zone plate as claimed in claim 11, wherein the aspect ration (H/P) increases toward an edge of the zone plate.

13. A zone plate as claimed in claim 11, wherein the central region of the zone plate is absorbent for X-ray radiation.

14. A zone plate as claimed in claim 11, wherein the zone plate is a zone plate operating with Bragg reflection.

15. A zone plate as claimed in claim 11, wherein zones of the zone plate are applied to a wire or a polished ball.

16. A zone plate as claimed in claim 11, wherein the zone plate is arranged in an X-ray microscope perpendicular to an X-ray microscope optical axis.

17. A zone plate as claimed in claim 11, wherein the zone plate is arranged in an X-ray microscope, and wherein, in a region near the optical axis of the X-ray microscope, zones of the zone plate are aligned parallel to said axis, and are increasingly inclined with respect to the optical axis toward an edge of the zone plate.

18. A zone plate as claimed in claim 11, wherein the zone plate is arranged in an X-ray microscope, and wherein the zone plate is annularly constructed for a condenser-monochromator, and a monochromator pinhole diaphragm is arranged at its focus.

19. A zone plate as claimed in claim 11, wherein the zone plate is an annular zone plate arranged in an X-ray microscope, and wherein a focussing device with a focussing ring is provided upstream in a beam path of the X-ray microscope to provide a condenser-monochromator, and wherein a monochromator pinhole diaphragm is arranged at the focus of the zone plate.

20. A zone plate as claimed in claim 11, wherein the zone plate is arranged in an X-ray microscope as a microscope objective.

21. A zone plate as claimed in claim 11, wherein the zone plate has a rectilinear grating structure.

* * * * *